US005779351A

United States Patent [19]

Erickson et al.

[11] Patent Number: 5,779,351

[45] Date of Patent: Jul. 14, 1998

[54] MATRIX DISPLAY WITH MULTIPLE PIXEL LENS AND MULTIPLE PARTIAL PARABOLIC REFLECTOR SURFACES

[75] Inventors: Troy A. Erickson; Vernon P. Voelzke, both of Brookings, S. Dak.

[73] Assignee: Daktronics, Inc., Brookings, S. Dak.

[21] Appl. No.: 433,895

[22] Filed: May 2, 1995

[51] Int. Cl.[6] ..... F21V 7/06

[52] U.S. Cl. ..... 362/241; 362/373; 362/812; 362/304; 362/245; 362/240

[58] Field of Search ..... 362/237, 240, 362/241, 247, 249, 231, 242, 243, 244, 245, 246, 248, 252, 238, 294, 251, 373, 374, 375, 343, 345, 346, 297, 307, 308, 812, 800, 339, 309, 304; 345/32, 59; 40/564, 552

[56] References Cited

U.S. PATENT DOCUMENTS

| | | | |
|---|---|---|---|
| D. 244,725 | 6/1977 | Niehaus et al. | D96/12 R |
| D. 245,289 | 8/1977 | Niehaus et al. | D96/12 R |
| D. 246,400 | 11/1977 | Niehaus et al. | D96/12 J |
| D. 271,219 | 11/1983 | Morrison | D20/42 |
| D. 279,585 | 7/1985 | Seggerson et al. | D20/10 |
| D. 279,587 | 7/1985 | Seggerson et al. | D20/42 |
| D. 331,604 | 12/1992 | Niehaus | D20/12 |
| 492,320 | 2/1893 | Bodkin . | |
| 580,557 | 4/1897 | Schwerin . | |
| 1,003,724 | 9/1911 | Felver . | |
| 1,025,896 | 5/1912 | Zubli et al. . | |
| 1,273,084 | 7/1918 | Momb . | |
| 1,391,229 | 9/1921 | Wendt . | |
| 1,442,463 | 1/1923 | Bowman . | |
| 1,457,980 | 6/1923 | McMasters | 362/339 |
| 1,495,674 | 5/1924 | Cochrane . | |
| 1,526,425 | 2/1925 | Limpert . | |
| 1,664,332 | 3/1928 | Stott . | |
| 1,786,033 | 12/1930 | Smith . | |
| 1,820,086 | 8/1931 | Naylor . | |
| 1,888,377 | 11/1932 | Eschenbach . | |
| 2,016,474 | 10/1935 | Wood | 250/34 |
| 2,038,409 | 4/1936 | Bone | 40/133 |
| 2,080,120 | 5/1937 | Everett | 240/47 |
| 2,094,689 | 10/1937 | Wells | 177/329 |
| 2,154,109 | 4/1939 | Parks | 40/132 |
| 2,242,525 | 5/1941 | Kirlin | 240/47 |
| 2,295,863 | 9/1942 | Paradis | 240/47 |
| 2,327,270 | 8/1943 | Johnson | 40/32 |
| 2,349,485 | 5/1944 | Corley | 177/337 |

(List continued on next page.)

FOREIGN PATENT DOCUMENTS 25 48 380 5/1977 Germany .

OTHER PUBLICATIONS

American Sign & Indicator Corporation product specifications, the Outdoor American Eagle, 2 pages, Dec. 19, 1988.

American Sign & Indicator Corporation product specifications, the Phoenix electronic display, 2 pages, Dec. 19, 1988.

Daktronics, Inc., "Starburst® 1200 Series Outdoor Color Display Systems by Daktronics, Inc.", 1 page, 1991.

*Primary Examiner*—Thomas M. Sember

*Attorney, Agent, or Firm*—Schwegman, Lundberg, Woessner & Kluth, P.A.

[57] ABSTRACT

A lamp matrix display includes a vertical planar array of light sources arranged in rows and columns and a plurality of reflectors positioned about corresponding light sources and having reflector surfaces for directing the light emitted from the light source in a forward direction. The reflective surface of at least one of the reflectors includes multiple parabolic reflective surfaces having offset focal points. At least one lens is mounted in front of the reflectors. The lens may be a single lens having an inner flat surface disposed adjacent an outer edge of each reflector surface and an outer prismatic surface having vertical prisms to horizontally spread the light from the planar array of light sources. Further, the plurality of reflectors may be structurally supported about corresponding light sources by a matrix framework and the matrix framework may include a plurality of air vents.

21 Claims, 16 Drawing Sheets

U.S. PATENT DOCUMENTS

| | | | |
|---|---|---|---|
| 2,576,849 | 11/1951 | Moore | 177/329 |
| 2,597,680 | 5/1952 | Sissler | 88/14 |
| 2,893,148 | 7/1959 | Figman | 40/132 |
| 3,051,937 | 8/1962 | Arthur | 340/332 |
| 3,127,111 | 3/1964 | Baring | 240/1.3 |
| 3,137,082 | 6/1964 | Phlieger, Jr. | 40/130 |
| 3,222,985 | 12/1965 | Remesat | 88/24 |
| 3,227,040 | 1/1966 | Dauser | 88/24 |
| 3,273,140 | 9/1966 | Foster et al. | 340/334 |
| 3,291,975 | 12/1966 | McCullough et al. | 240/11.2 |
| 3,311,745 | 3/1967 | Gossner | 240/41.1 |
| 3,348,036 | 10/1967 | Bodian et al. | 240/41.35 |
| 3,425,146 | 2/1969 | Winstanley | 40/132 |
| 3,582,937 | 6/1971 | Dozer et al. | 340/325 |
| 3,598,984 | 8/1971 | Slomski | 240/1.3 |
| 3,711,702 | 1/1973 | Adra | 240/47 |
| 3,750,138 | 7/1973 | Burgan et al. | 340/334 |
| 3,762,085 | 10/1973 | Raich et al. | 40/130 K |
| 3,768,188 | 10/1973 | Kurtenbach et al. | 40/130 E |
| 3,784,768 | 1/1974 | Hunt | 200/52 R |
| 3,792,230 | 2/1974 | Ray | 219/343 |
| 4,006,476 | 2/1977 | Romney | 340/373 |
| 4,021,949 | 5/1977 | Niehaus et al. | 40/132 R |
| 4,045,895 | 9/1977 | Work | 40/28 C |
| 4,053,340 | 10/1977 | Work | 156/70 |
| 4,115,941 | 9/1978 | Stephenson | 40/452 |
| 4,118,763 | 10/1978 | Osteen | 362/339 |
| 4,158,222 | 6/1979 | Cook | 362/309 |
| 4,177,502 | 12/1979 | Hiscock | 362/218 |
| 4,186,394 | 1/1980 | Bobak et al. | 340/764 |
| 4,197,527 | 4/1980 | Romney | 340/378.1 |
| 4,228,596 | 10/1980 | Daniel | 35/9 B |
| 4,234,906 | 11/1980 | Schlinder | 362/339 |
| 4,234,914 | 11/1980 | Boeson | 40/550 |
| 4,254,453 | 3/1981 | Mouyard et al. | 362/241 |
| 4,271,408 | 6/1981 | Teshima et al. | 340/702 |
| 4,318,098 | 3/1982 | McGreevy | 340/764 |
| 4,380,879 | 4/1983 | Seibert | 40/447 |
| 4,383,290 | 5/1983 | Binder et al. | 362/290 |
| 4,389,804 | 6/1983 | Seibert et al. | 40/447 |
| 4,446,511 | 5/1984 | Sands | 362/267 |
| 4,460,947 | 7/1984 | Kelly | 362/374 |
| 4,475,791 | 10/1984 | Nixon | 350/127 |
| 4,530,041 | 7/1985 | Yamai et al. | 362/268 |
| 4,531,121 | 7/1985 | Brown | 340/764 |
| 4,535,394 | 8/1985 | Dugre | 362/231 |
| 4,549,250 | 10/1985 | Spector | 362/96 |
| 4,569,007 | 2/1986 | Dick | 362/294 |
| 4,578,742 | 3/1986 | Klein et al. | 362/294 |
| 4,587,754 | 5/1986 | Ossner | 40/564 |
| 4,620,791 | 11/1986 | Combastet | 356/420 |
| 4,635,173 | 1/1987 | Dressler et al. | 362/294 |
| 4,641,226 | 2/1987 | Kratz | 362/218 |
| 4,682,432 | 7/1987 | Taylor et al. | 40/573 |
| 4,683,491 | 7/1987 | Shimada et al. | 358/56 |
| 4,724,629 | 2/1988 | Walton | 40/451 |
| 4,733,486 | 3/1988 | Gawell | 40/451 |
| 4,742,432 | 5/1988 | Thillays et al. | 361/400 |
| 4,783,920 | 11/1988 | Muller-Tolk | 40/550 |
| 4,833,542 | 5/1989 | Hara et al. | 358/230 |
| 4,843,527 | 6/1989 | Britt | 362/231 |
| 4,930,051 | 5/1990 | Golz | 362/336 |
| 4,935,665 | 6/1990 | Murata | 362/800 |
| 5,097,258 | 3/1992 | Iwaki | 340/815.1 |
| 5,148,156 | 9/1992 | Huber et al. | 40/449 |
| 5,268,828 | 12/1993 | Miura | 362/249 |
| 5,295,050 | 3/1994 | Helstern et al. | 362/339 |
| 5,321,417 | 6/1994 | Voelzke et al. | 40/550 |

MATRIX DISPLAY WITH MULTIPLE PIXEL LENS AND MULTIPLE PARTIAL PARABOLIC REFLECTOR SURFACES

FIELD OF THE INVENTION

The present invention relates to lamp matrix displays. More particularly, the present invention relates to matrix display modules used in signs or other visual display systems. Such signs or systems for use in sports arenas or any other sites for the display of pictorial and/or alpha-numerical images. Further, the present invention relates to utilizing prismatic surfaces and parabolic surfaces, along with pressurized cooling, for an outdoor or indoor display.

BACKGROUND OF THE INVENTION

Various existing lamp matrix displays are in existence. Some matrix displays are utilized in indoor settings and some are utilized in outdoor settings. For example, various matrix display modules are available from Daktronics, the assignee hereof. Some embodiments of a video display panel are described in U.S. Pat. No. 5,321,417 to Voelzke et al.; which is currently assigned to the assignee hereof. Further, other embodiments of matrix lamp bank displays are described in U.S. Pat. No. 4,843,527 to Britt. The matrix lamp displays described in U.S. Pat. Nos. 4,843,527 and 5,321,417 are display panels which include either individual filters or individual lenses positioned in front of individual lamps in the matrix display.

In addition to visual display panels which include individual filters or individual lenses positioned in front of each individual lamp of the matrix display, other existing matrix display modules have used a single filter that covers multiple lamps. In both types of display modules, whether using individual lenses for each lamp or a single filter for multiple lamps, reflectors are normally utilized with the lamps to direct the light from the lamps in a certain direction. Individual reflectors for a single lamp or multiple reflectors connected in some fashion to one another are currently in existence.

There are many different sizes of display modules and displays. The display modules include lamps spaced at various distances. For example, the lamps may be spaced at ¾" center-to-center, 1½" center-to-center, 3" center-to-center, etc. Such display modules may be utilized to create larger displays by positioning multiple modules alongside one another in many different combination.

Various problems exist with regard to the manner in which some displays provide for wide angle light viewing. Different types of lenses have been utilized in the past with different types of display modules. For example, existing products of Daktronics, the assignee hereof, utilize different types of lenses for different displays. There are long distance lenses, typically used in highway applications, which provide viewing at greater distances. Light is directed forward, more to the front of the display, rather than to the sides of the display. Wide angle lenses have also been utilized which distribute light more to each side of the display to provide better viewing at wider angles. The wide angle lenses are typically used in sports facilities so fans have a great view of the display from almost any seat.

Although filters have been utilized in the past, with regard to multiple pixel matrix display modules having a single filter covering multiple pixels, improvement in the structure of such modules for utilizing a single filter is always needed. Further, when attempting to achieve wide angle light viewing, straightforward illuminance intensity from the display modules may be lacking. In order to provide for such straightforward illuminance intensity, high voltages have been utilized for driving the lamps of the matrix display modules. Such high voltage decreases the life of the lamp and therefore, maintenance costs are increased. Moreover, multiple pixel lamp display modules must be cooled to assure that the displays allow for air flow to reduce temperature within the matrix lamp display. There is always a need for improved cooling techniques. These problems/needs and others will become more apparent when reviewing the description of the preferred embodiment below.

SUMMARY OF THE INVENTION

The present invention is directed to overcome the problems of the prior art and/or improve upon the prior art by utilizing multiple pixel prismatic lenses and multiple partial parabolic reflector surfaces to provide wide angle viewing and straightforward illuminance intensity. In performing such function, energy is saved and lamps may be driven utilizing a lesser voltage to increase lamp life. The lamp life is further lengthened through an improved cooling structure.

A lamp matrix display in accordance with the present invention includes a vertical planar array of light sources arranged in rows and columns and a plurality of reflectors. Each reflector is positioned about a corresponding light source and has a reflector surface for directing the light emitted from the light source in a forward direction. The reflector surface of at least one of the reflectors includes at least two partial parabolic reflective surfaces. Such partial parabolic reflective surfaces include a first parabolic reflective surface having a first focal point and a second parabolic reflective surface adjacent the first parabolic reflective surface but rotated with respect to the first parabolic surface such that second focal point is offset from the first focal point of the first parabolic surface. At least one lens is mounted in front of at least one of the plurality of reflectors.

In one embodiment of the invention, a single lens is mounted directly in front of the plurality of reflectors. The single lens includes an inner flat surface disposed adjacent an outer edge of each reflector surface and an outer prismatic surface having vertical prisms to horizontally spread the light from the planar array of light sources. This multiple pixel prismatic lens may be utilized in combination with a reflector having the multiple partial parabolic surfaces or with reflectors that do not have such surfaces.

In another embodiment of the invention, a lamp matrix display includes a vertical planar array of light sources arranged in rows and columns and a plurality of reflectors positioned about corresponding light sources and having a reflective surface for directing the light emitted from the light source in a forward direction. A single lens is mounted directly in front of the plurality of reflectors and a matrix framework structurally supports the plurality of reflectors about the corresponding light sources. The matrix framework includes a plurality of air vents with at least one of the air vents being positioned between four adjacent reflectors. The air vent includes a recessed region in the matrix framework open in the forward direction and recessed below a plane established by the outer edges of each reflector surface and a recessed channel extending from the recessed region to an interrupt in the outer edge of the reflective surfaces of each of the four adjacent reflectors. In one embodiment of the air vent, a light blocking structure is disposed in the recessed region to block light exiting through the recessed channels extending from the recessed region to the interrupt in the outer edge of the reflective surfaces of each of the four adjacent reflectors.

In yet another embodiment, a lamp matrix display includes a vertical planar array of light sources arranged in rows and columns and a plurality of reflectors positioned about corresponding light sources and having a reflective surface for directing the light emitted from the light source in a forward direction. A single lens is mounted directly in front of the plurality of reflectors and a matrix framework structurally supports the plurality of reflectors about the corresponding light sources. The matrix framework includes a plurality of mounting projections extending forwardly from the matrix framework and forward of the plurality of reflectors. The single lens includes a plurality of retaining apertures. Each retaining aperture corresponds to one of the mounting projections and is positioned in the single lens for receiving the corresponding mounting projections and engaging the corresponding mounting projections to lock the single lens directly and in contact with the outer edge of each reflector surface.

DESCRIPTION OF THE PREFERRED EMBODIMENT

Figure 4A:
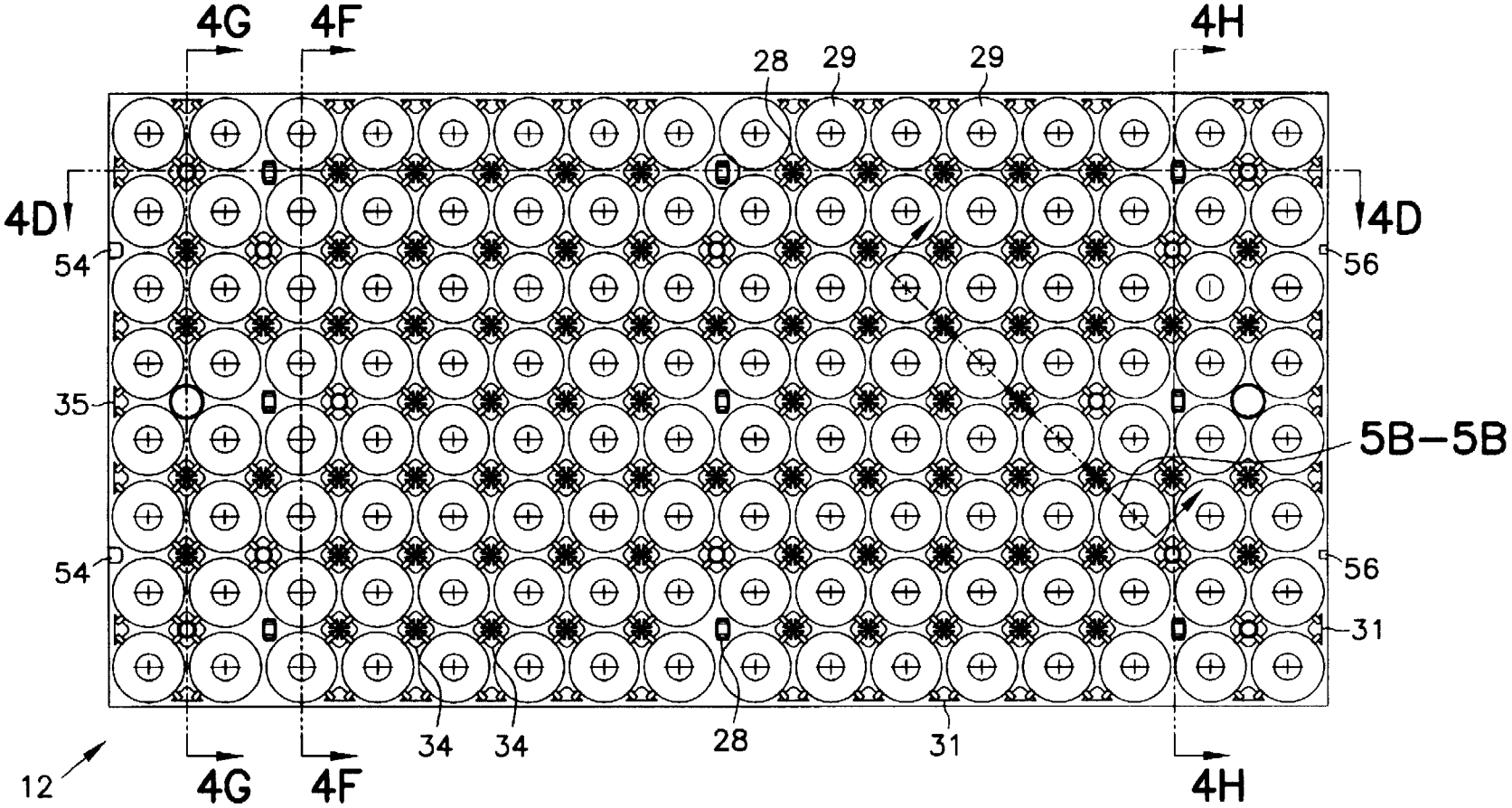
FIG. 4A is a front view of a multiple pixel reflector as shown in FIG. 2A.

Referring to FIGS. 1A–1B, 2A–2C, and 4A, a multiple pixel lamp matrix display module 10, in accordance with the present invention, is generally described. As is shown in FIG. 4A, the multiple pixel lamp matrix display module 10 includes a plurality of reflectors 29. The plurality of reflectors are arranged in 8 rows and 16 columns for a total of 128 reflectors. Each reflector corresponds to 128 pixel areas for the multiple pixel lamp matrix display module 10.

Any number of multiple pixel lamp matrix display modules 10 may be positioned aside one another to form an overall sign or multiple module display (not shown). The multiple module display may be mounted at various sites for viewing. For example, such multiple module displays may be supported on posts above the ground outside, or in an indoor or outdoor stadium. Any number of pixels may be incorporated into a display and the present invention is not limited to any predetermined number.

Generally, several multiple pixel lamp matrix display modules 10 are mounted alongside one another in an overall module housing or cabinet (not shown) with the use of mounting hardware. One example of mounting structure for rear access mounting and front access mounting is further described below. The multiple pixel lamp matrix display module 10 includes structure such that when a multiple number of display modules 10 are mounted in an overall module housing or cabinet, an entire display module 10 may be removed for repair or replacement from the front of the multiple module display. Having front access for removal of the entire display module 10 has the advantage of fast and efficient replacement of the module for maintenance.

Within the overall module housing or cabinet, air pressurizing fans (not shown) are utilized to draw cool air into the housing and maintain positive air pressure within the overall module housing or cabinet. In order to maintain overall module housing or cabinet air pressure to more evenly cool lamps, weatherstripping 20 is provided along two sides of the multiple pixel lamp matrix display module 10 such that when they are placed next to one another air is substantially prevented from escaping therebetween. As described further below, the pressurized air is forced from behind the modules 10 through air slots alongside lamps in order to provide air into a cavity 15 formed by a multiple pixel prismatic lens 14 and each reflector 29 of the multiple pixel reflector 12. This cavity is best shown in FIG. 1B.

Figure 1A:
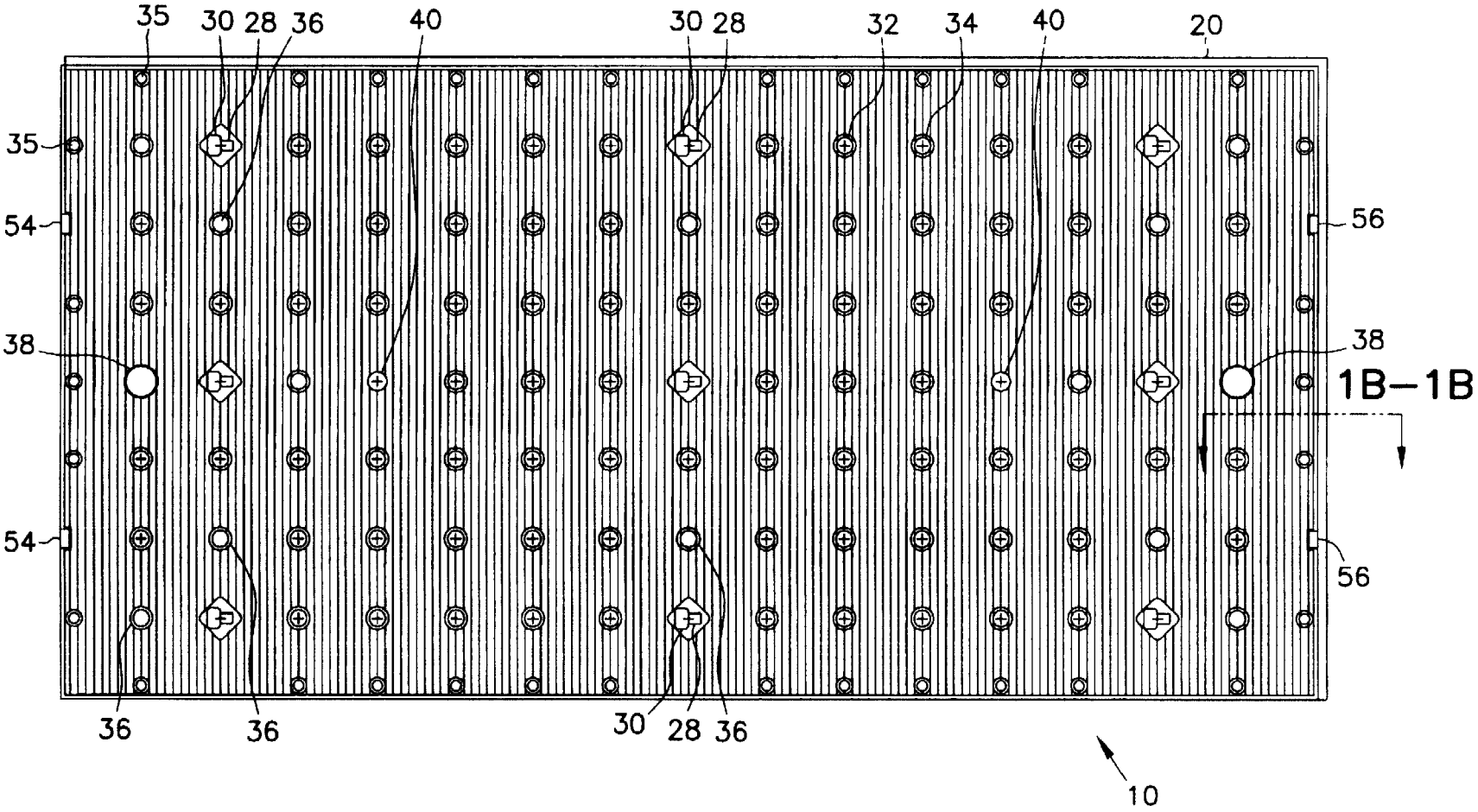
FIG. 1A is a front view of a multiple pixel lamp matrix display module in accordance with the present invention.
Figure 1B:
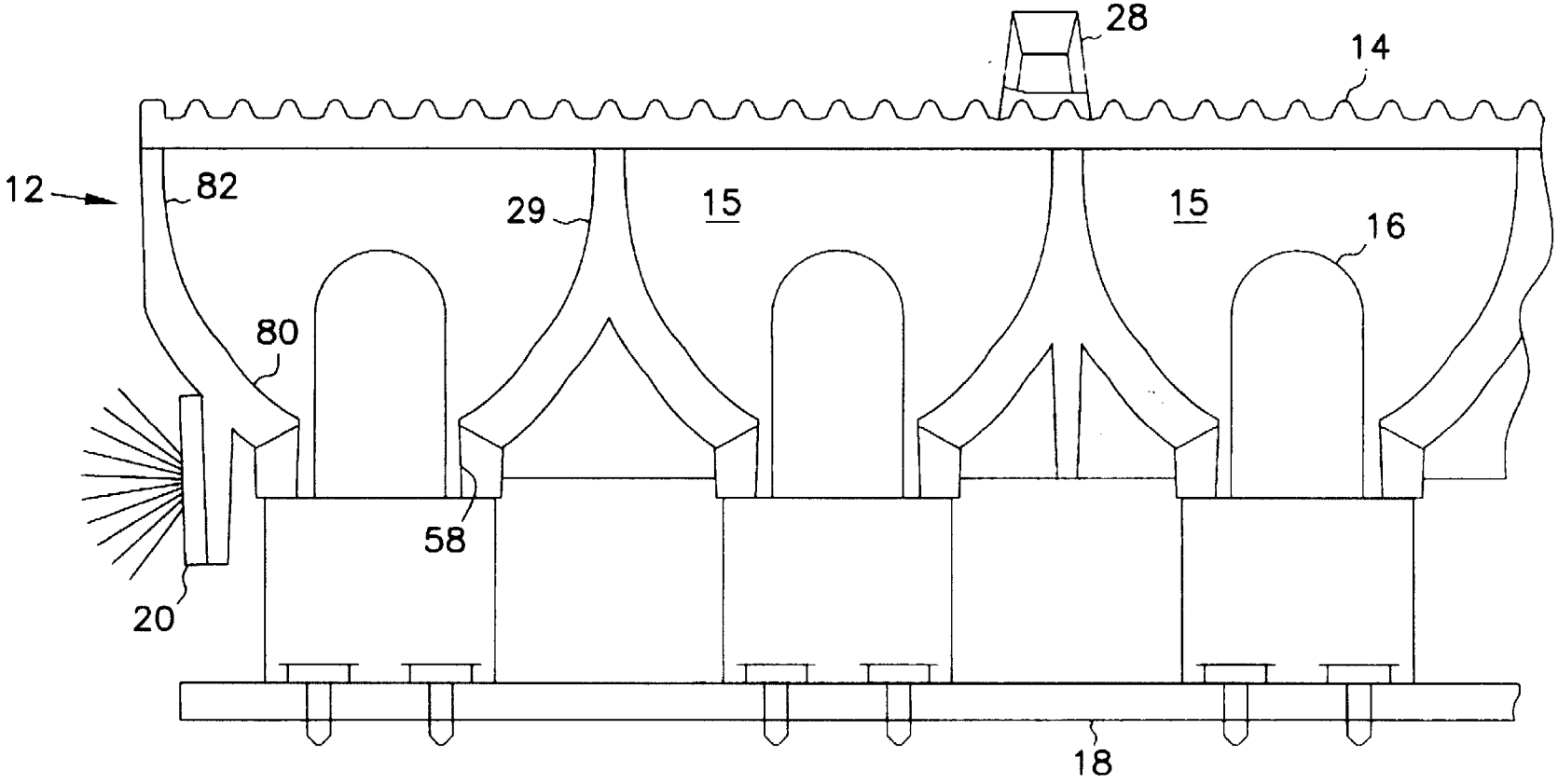
FIG. 1B is a section view on line 1B—1B of the front view of the multiple pixel lamp matrix display module of FIG. 1A.
Figure 2A:
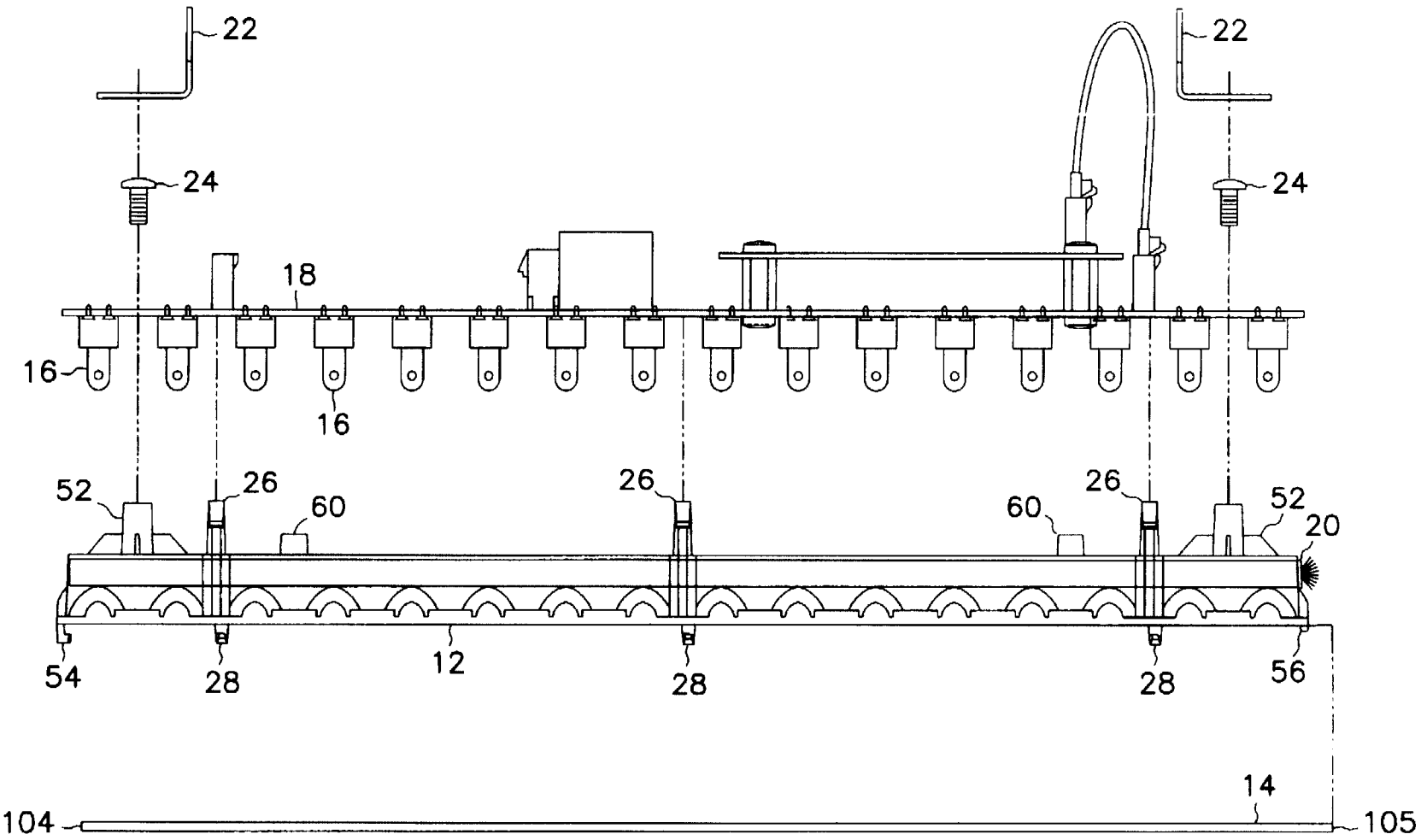
FIG. 2A is an exploded top view of the multiple pixel lamp matrix display module of FIG. 1.
Figure 2B:
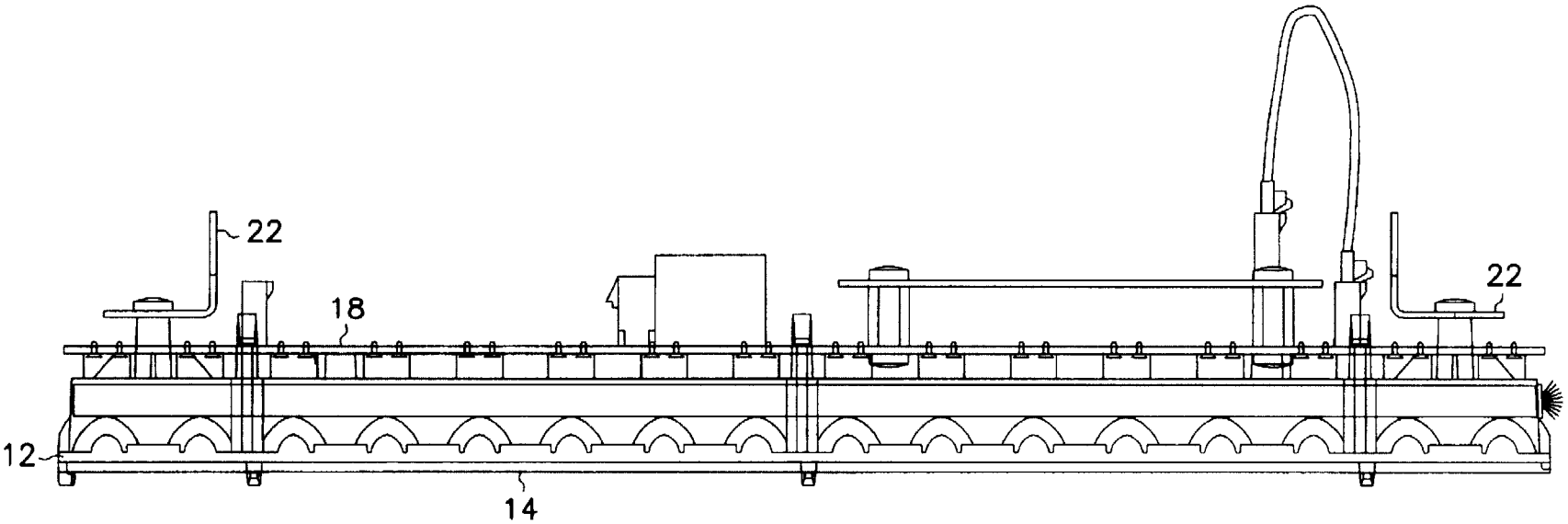
FIG. 2B is an assembled top view of the multiple pixel lamp matrix display module of FIG. 2A.
Figure 2C:
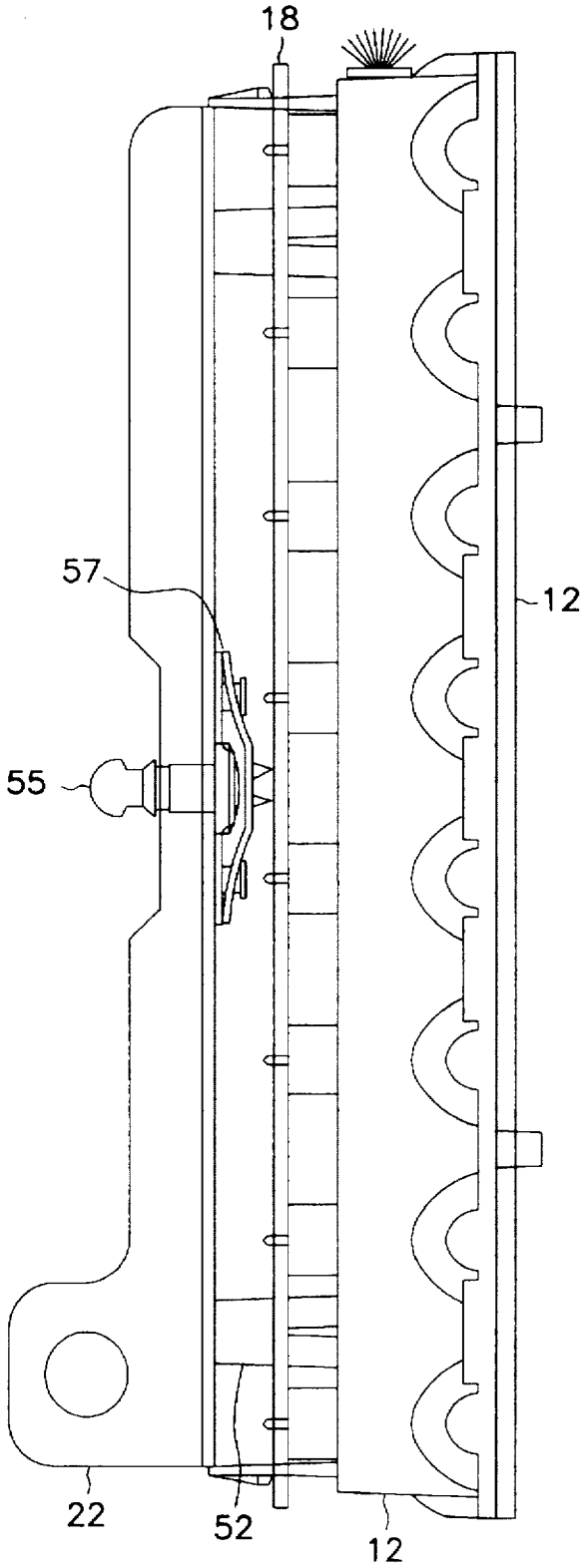
FIG. 2C is a side view of the assembled module of FIG. 2B.

The multiple pixel lamp matrix display module 10 is shown in an exploded view in FIG. 2A, a top assembled view in FIG. 2B, and a side assembled view in FIG. 2C. Further, a section view on line 1B—1B of FIG. 1A is shown in FIG. 1B. As shown in these figures, the multiple pixel lamp matrix display module 10 includes a printed circuit board 18 having a plurality of lamps 16 mounted thereon as shown in FIG. 2A along with circuitry for driving the lamps 16. The multiple pixel lamp matrix display module 10 further includes a multiple pixel reflector 12 into which the lamps 16 mounted on printed circuit board 18 are positioned, and a multiple pixel prismatic lens 14.

Figure 3:
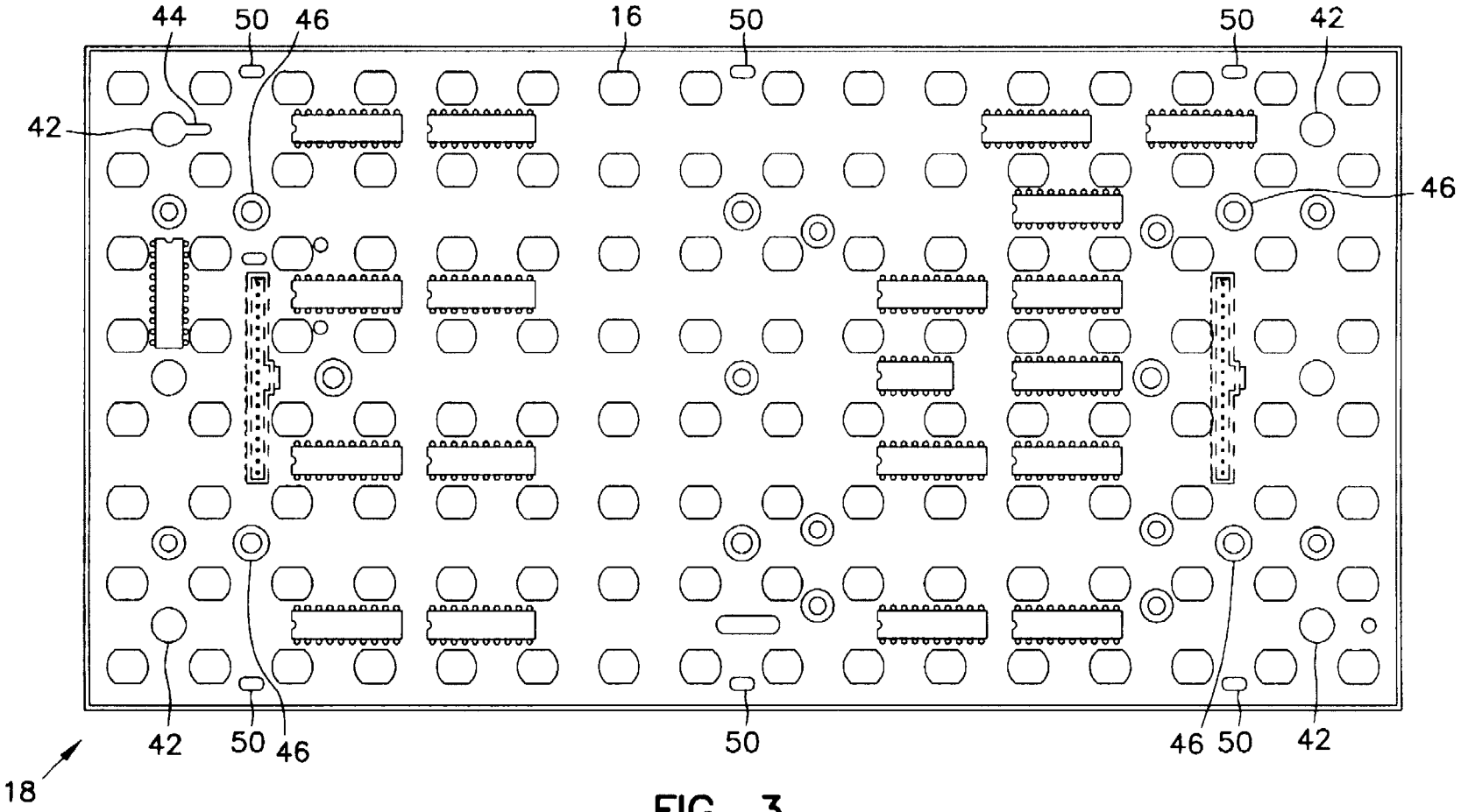
FIG. 3 is a front view of a lamp display board as shown in FIG. 2A.

With further reference to FIGS. 1A–1B and FIGS. 2A–2C, the assembly of multiple pixel lamp matrix display module 10 shall be generally described. Then further detail of the multiple pixel lamp matrix display module 10 shall be described with reference to all of the figures. Generally, the multiple pixel reflector 12 includes printed circuit board mounting clips 26, which engage in printed circuit board clip holes 50 of printed circuit board 18, as shown in FIG. 3. Standoffs 52 and other standoffs as described further below, provide for spacing between the printed circuit board 18 and the multiple pixel reflector 12. When the printed circuit board 18 is snapped into place by means of clips 26 and board clip holes 50, the lamps 16 extend into the reflector cavities 15 as shown in FIG. 1B. Also, after the printed circuit board 18 is snapped into place, mounting brackets 22 are attached.

One mounting bracket 22 is mounted near each side edge of the printed circuit board 18 by way of fasteners 24, and reflector standoff bracket and screw mounts 52. The mounting brackets 22 each include two keyholes (not shown). The key holes allow the fasteners 24 to be turned into reflector standoff bracket screw mounts 52, such that the keyholes of the mounting brackets 22 can be slipped over the fasteners, locked into place, and then tightened down. One in the art will recognize that in means of fastening mounting brackets 22 through apertures in the printed circuit board 18 and to the multiple pixel reflector 12 may be utilized without departing from the spirit and scope of the present invention.

With the brackets 22 positioned as shown in FIG. 2C, a ¼-turn stud 55 is positioned in mounting bracket 22, such that the ¼-turn stud 55 may be accessed through forward mounting hole 38 as shown in FIG. 1A. The ¼-turn stud 55 can then be utilized through the forward mounting holes 38 to engage a ¼-turn receptacle (not shown) such that the multiple pixel lamp matrix display module 10 can be mounted in a cabinet or overall housing module from the front of the display module. Thus, the entire display module 10, which is mounted by means of the ¼-turn stud 55 through the forward mounting holes 38, can be removed in a like manner.

If the display module 10 is to be mounted from the rear, instead of a ¼-turn stud 55 being utilized on the mounting bracket 22, a ¼-turn receptacle 57 is mounted thereon. A ¼-turn stud (not shown) would then be utilized from the rear to engage the ¼-turn receptacle 57 to mount the display module 10 in the cabinet.

Further, generally with respect to FIGS. 1A–1B and FIGS. 2A–2C, the multiple pixel prismatic lens 14 is mounted adjacent to the multiple pixel reflector 12, as best shown in FIGS. 1B and 2B, by means of lens keyhole mount retainer 30 of lens 14, mount tees 28 of multiple pixel reflector 12, lens retainer tabs 54 (best shown in FIG. 4C) multiple pixel reflector 12, and lens edge knob tab 56 (also best shown in FIG. 4C) multiple pixel reflector 12. As shown in the exploded view of the multiple pixel lamp matrix display module 10 of FIG. 2A, the multiple pixel prismatic lens 14 is held slightly in misalignment with the multiple pixel reflector 12 such that the mounting tees 28 of the multiple pixel reflector 12 can be positioned into lens keyhole mount retainers 30. With all of the mounting tees 28 in the lens keyhole mount retainers 30 of the multiple pixel prismatic lens 14, the prismatic lens 14 is then slid across the front of the multiple pixel reflector 12 such that the mounting tees 28 lock within the lens keyhole mount retainers 30 and the edge 104 of the multiple pixel prismatic lens 14 is engaged within retainer catch tabs 54. The edge 105 of multiple pixel prismatic lens 14 is then forced to abut the lens edge knob tabs 56 of the multiple pixel reflector 12. As assembled, the multiple pixel prismatic lens 14 is in contact with the front surface of the multiple pixel reflector 12.

To remove the multiple pixel prismatic lens 14, the above steps are reversed. The prismatic lens 14 is first lifted such that edge 105 of the prismatic lens is not abutting the lens edge knob tabs 56, and then the multiple pixel prismatic lens 14 is slid to release edge 104 from the lens retainer catch tabs 54 and to release the mounting tees 28 from the lens keyhole mount retainers 30. With this easy and effective means of mounting the multiple pixel prismatic lens 14, service for such lenses is simplified.

After assembly, the multiple pixel lamp matrix display module 10 may be mounted with other display modules to form the multiple module display as discussed above. As is well understood in the art, the lamps 16 for the plurality of pixels of the display are energized in a preprogrammed sequence through an electronic control system or driver unit.

In order to reduce the voltage utilized to drive the lamps 16 in a preprogrammed sequence, the multiple prismatic lens 14 includes vertical prisms 17 on its outer surface to spread the light horizontally for wide angle light viewing and energy savings. Also, each reflector 29 of the multiple pixel reflector 12 includes two partial parabolic surfaces 80, 82, as shown in FIG. 1B, which are rotated and off focal point to provide wide angle viewing and straightforward illuminance intensity. With this combination, the voltage utilized to drive the lamps 16 in the predetermined sequence and still obtain the same wide angle light viewing and straightforward illuminance intensity as previous designs can be reduced. For example, in a lamp display module having lamps at ¾" center-to-center positions, the voltage may be decreased from about 28 to 23 volts. This decrease in voltage lengthens the lamp life and thus requires less maintenance for the display module 10. Further, air vents 34 of the lamp matrix display module 10 provide ventilation and cooling for the display module 10 without decrease in viewing quality, as shall be described further below with reference to FIGS. 5A–5E.

Further detail with regard to the assembled multiple pixel lamp matrix display module 10 shall now be described with reference to all of the figures. The multiple pixel reflector 12 is shown in detail in FIGS. 4A–4J, FIGS. 5A–5D, and FIGS. 6A–6C. As shown in the front view, FIG. 4A, the multiple pixel reflector 12 includes multiple reflectors 29 corresponding to multiple pixels of multiple pixel lamp matrix display module 10. The plurality of reflectors 29 are positioned in row and column matrix form. The multiple pixel reflector 12 includes 16 columns and 8 rows of reflectors 29 structurally supported in the row and column form by matrix framework 31.

The matrix framework 31 includes a plurality of edge air vents 35 along the edges of the multiple pixel reflector 12. The edge air vents 35, include a triangular shaped recess substantially one half the size of air vents 34, which will be described in further detail below. The edge air vents 35 receive air from two adjacent reflectors 29 through interrupts in the upper edge of each reflector which forms a channel into the edge air vent 35. The edge air vent is substantially the same as the air vent 34 shown in detail in FIG. 5C and FIG. 5D but without the air vent light barriers 69 shown therein. When the multiple pixel prismatic lens 14 is mounted on the multiple pixel reflector 12 and air is pressurized from the rear and into cavities 15, shown in FIG. 1B, the air is forced through the channels between the cavity and the edge air vent 34 and is forced out the lens edge air vent apertures 33, shown in FIG. 7A.

Figure 5A:
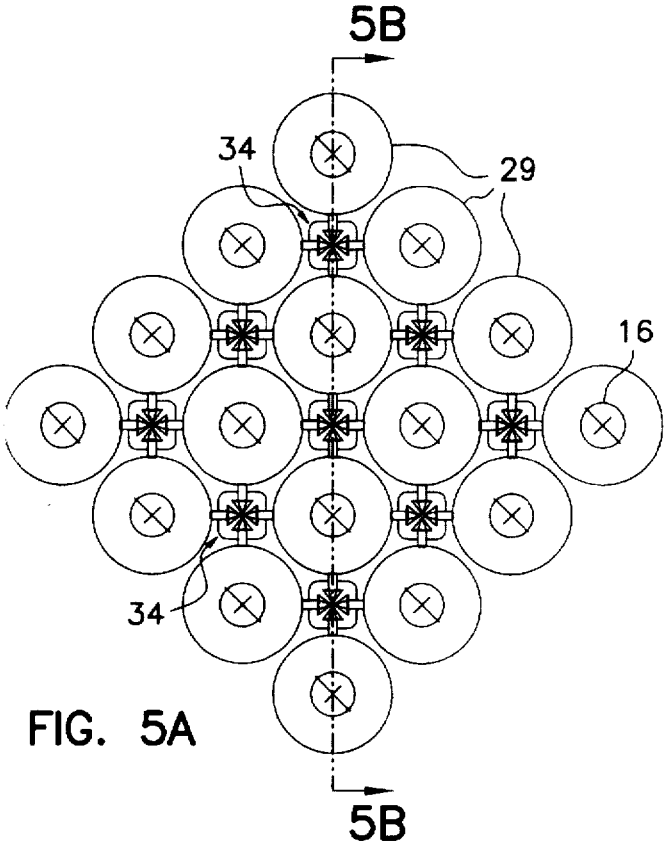
FIG. 5A is a top view of a multiple number of reflectors of the multiple pixel reflector of FIG. 4A rotated 45°.
Figure 5B:
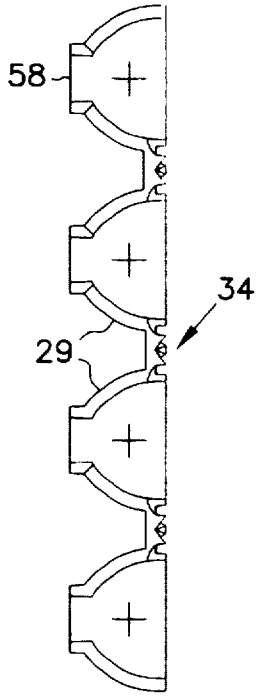
FIG. 5B is a section view of the multiple number of reflectors of the multiple pixel reflector on the line 5B—5B of FIG. 5A.
Figure 5C:
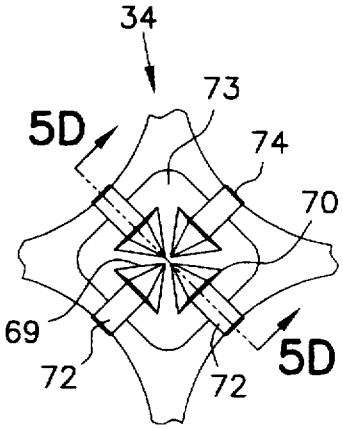
FIG. 5C is a detailed top view of an air vent of the multiple pixel reflector of FIG. 4A and the multiple number of reflectors of FIG. 5A.
Figure 5D:
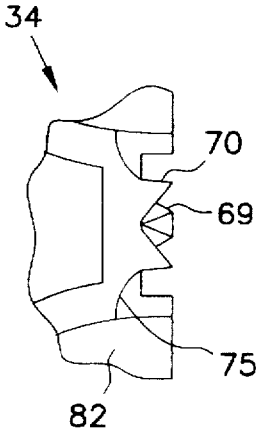
FIG. 5D is a detailed section view of the air vent on the line 5B—5B of FIG. 5A and 5B.
Figure 5E:
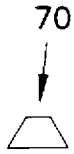
FIG. 5E is a detailed view of an air vent light barrier face as shown in FIG. 5C looking from within a reflector of the multiple pixel reflector through an interrupted outer edge of that reflector.

The matrix framework 31 also includes the air vents 34, which are not positioned next to the edges of the multiple pixel reflector 12 but rather more centrally. The air vents 34 are best described with reference to the detailed diagrams of FIG. 5A–FIG. 5E. FIG. 5A is a top view of 16 reflectors 29 rotated 45° with respect to the reflectors 29 as positioned in a multiple pixel reflector 12. Each air vent 34 provides a channel for ventilation from four reflectors 29. The air vent 34 is shown in further detail in a top view of FIG. 5C. Each air vent 34 includes four channels 72 extending from a substantially square recessed region 73 of the air vent 34 to the four different reflectors 29. A top edge of the reflectors 29 are interrupted in order to create the channels 72. The lower side of each channel 72 is an inclined surface 75, which extends deeper into the matrix framework than the recessed region 73. As such, air is moved much more efficiently through channel 72 from within the reflector cavity 15. This inclined surface 75 is shown in FIG. 5D, which is a detailed view of the air vent 34 as shown in the section view of FIG. 5B and which is on line 5D—5D of the detailed figure of FIG. 5C; and also shown in FIGS. 4A and 5A on line 5B.

Positioned within the square recessed region 73 are four air vent light barriers 69. The air vent light barriers 69 are a multifaceted structure having an air vent light barrier face 70, which face is positioned directly facing the interrupt opening 74 in the top edge of the reflectors 29 that forms channel 72. The inclined surface 75 is inclined from the light barrier face 70 to the reflector surface 82. The pyramidal shape of the air vent light barrier 69 is further shown in the section view of FIG. 5D. In particular, the air light barrier includes the air vent light barrier face 70 and three facets extending from each edge downward to a common point at the center of the square recessed region 73.

Figure 7A:
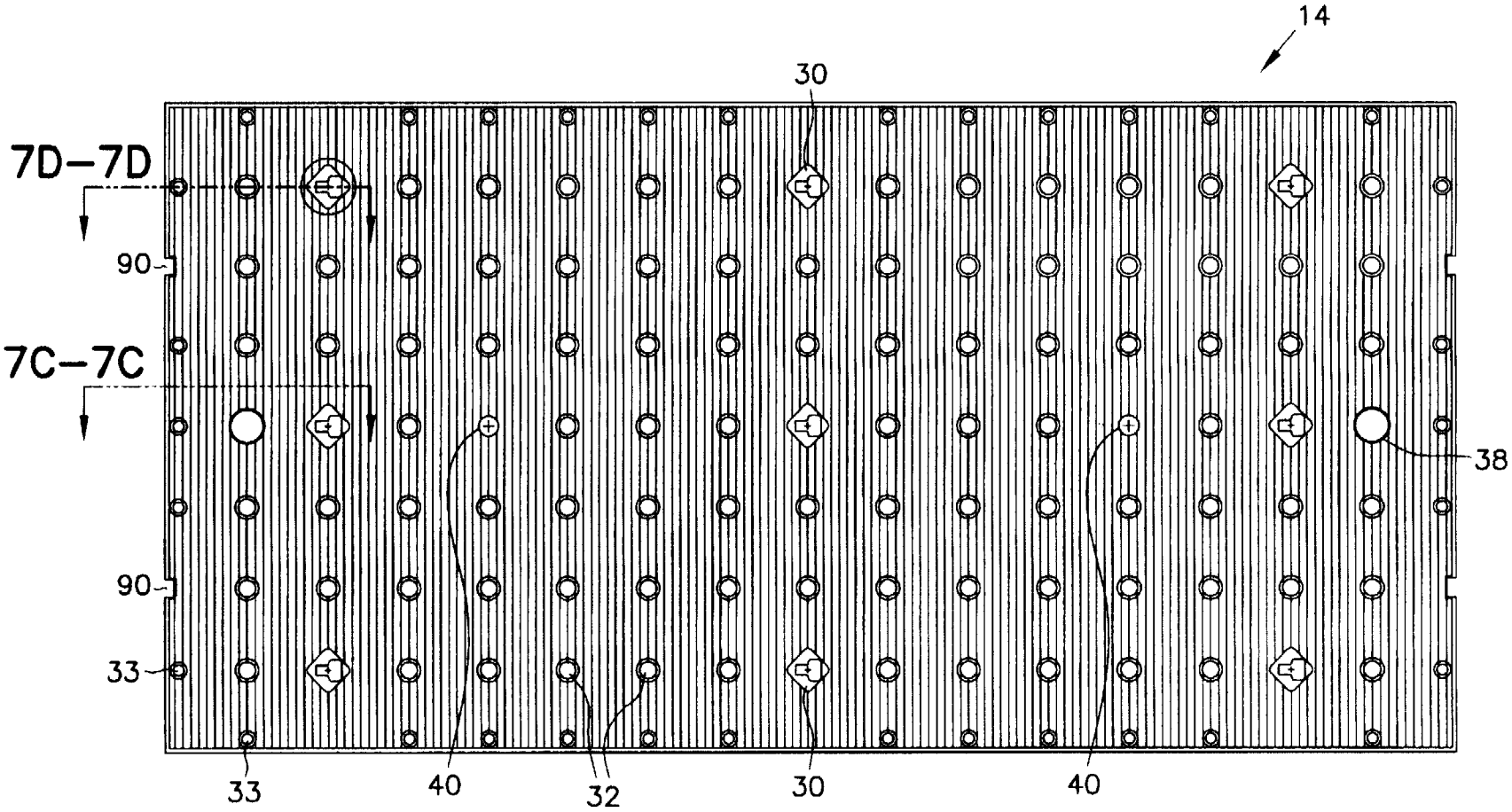
FIG. 7A is a front view of a multiple pixel prismatic lens of the multiple pixel lamp matrix display module of FIG. 1.

The air vents 34 ventilate the multiple pixel lamp matrix display module 10 in the following manner. With air pressurized from behind and into the cavities 15 as shown in FIG. 1B, air is forced from the cavity 15 of each of the four reflectors 29 serviced by an air vent 34 through the channel 72 and up inclined surface 75. The air is then within the recessed region 73 and is forced out of lens air apertures 32 of the multiple pixel prismatic lens 14. The lens air apertures 32 are shown in FIG. 7A. The air vent light barriers 69, or pyramid-shaped light blockers, allow the air to flow around the pyramid, but block the majority of the light attempting to exit through the channels 72. In this manner, efficient cooling is performed with little light loss.

The matrix framework 31 further has extending rearwardly therefrom and rearward of the reflectors 29, the circuit board mounting clips 26. There are six such clips 26, three at the top of the multiple pixel reflector 12 and three at the bottom of the multiple pixel reflector 12. The printed circuit board mounting clips 26, as previously discussed, allow the printed circuit board 18 to be snapped onto the multiple pixel reflector 12. The mounting clips 26 are aligned with the clip holes 50, three at the top and three at the bottom edge of the printed circuit board 18. A force is applied to the printed circuit board 18 in order for the printed circuit board 18 to snap onto the multiple pixel reflector 12 and become engaged with the board mounting clips 26. The board mounting clips 26 are shown in further detail in FIG. 4J. The clips 26 include a projection member 64 extending rearwardly from the matrix framework 31 with a holding member 66 for engagement with a clip hole 50 of the printed circuit board 18 at the distal end thereof. As structured, the clips 26 have some movement flexibility to allow for the snapping of the board 18 on the multiple pixel reflector and also for removal of the printed circuit board 18 from the multiple pixel reflector 12.

Figure 7B:
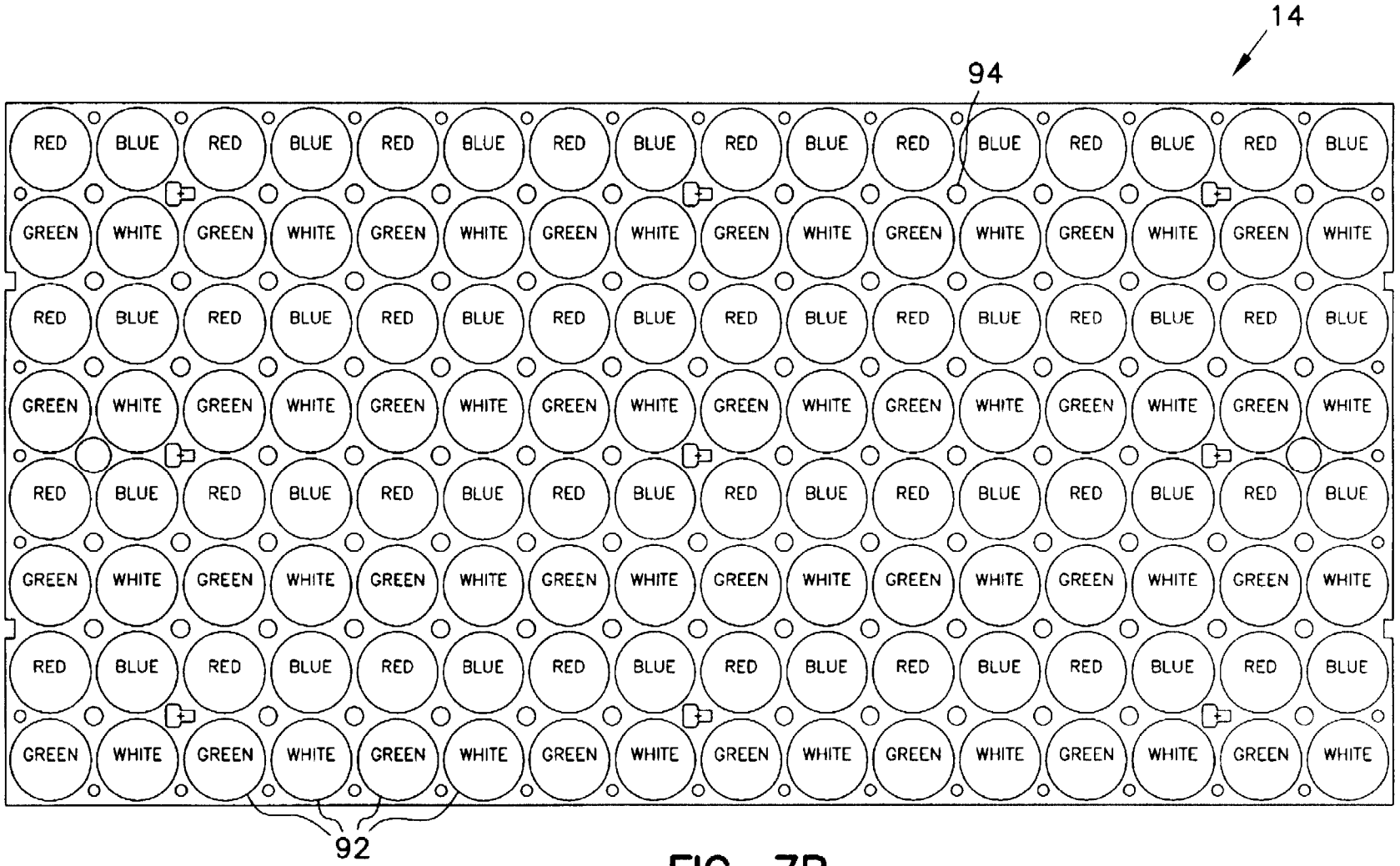
FIG. 7B is a rear view of the multiple pixel prismatic lens of FIG. 7A.

Extending forward from the matrix framework 31 are mounting tees 28. As discussed previously, the mounting tees 28 are for engagement in lens keyhole mount retainers 30 of the prismatic lens 14. The mounting tees 28 are shown in further detail in FIG. 41. The mounting tees include a projection member 107 extending perpendicularly to the matrix framework 31 and a holding member 108 for engaging the lens keyhole mount retainer 30. The lens keyhole mount retainer 30 is also shown in detail in FIG. 7E and includes an accepting region 96 and a locking region 98. The holding member 108 is chamfered on one side for allowing the mounting tee 28, when inserted in the accepting region 96, to be slid into the locking region 98. The chamfered edge is shown as the surface 109.

Figure 4B:
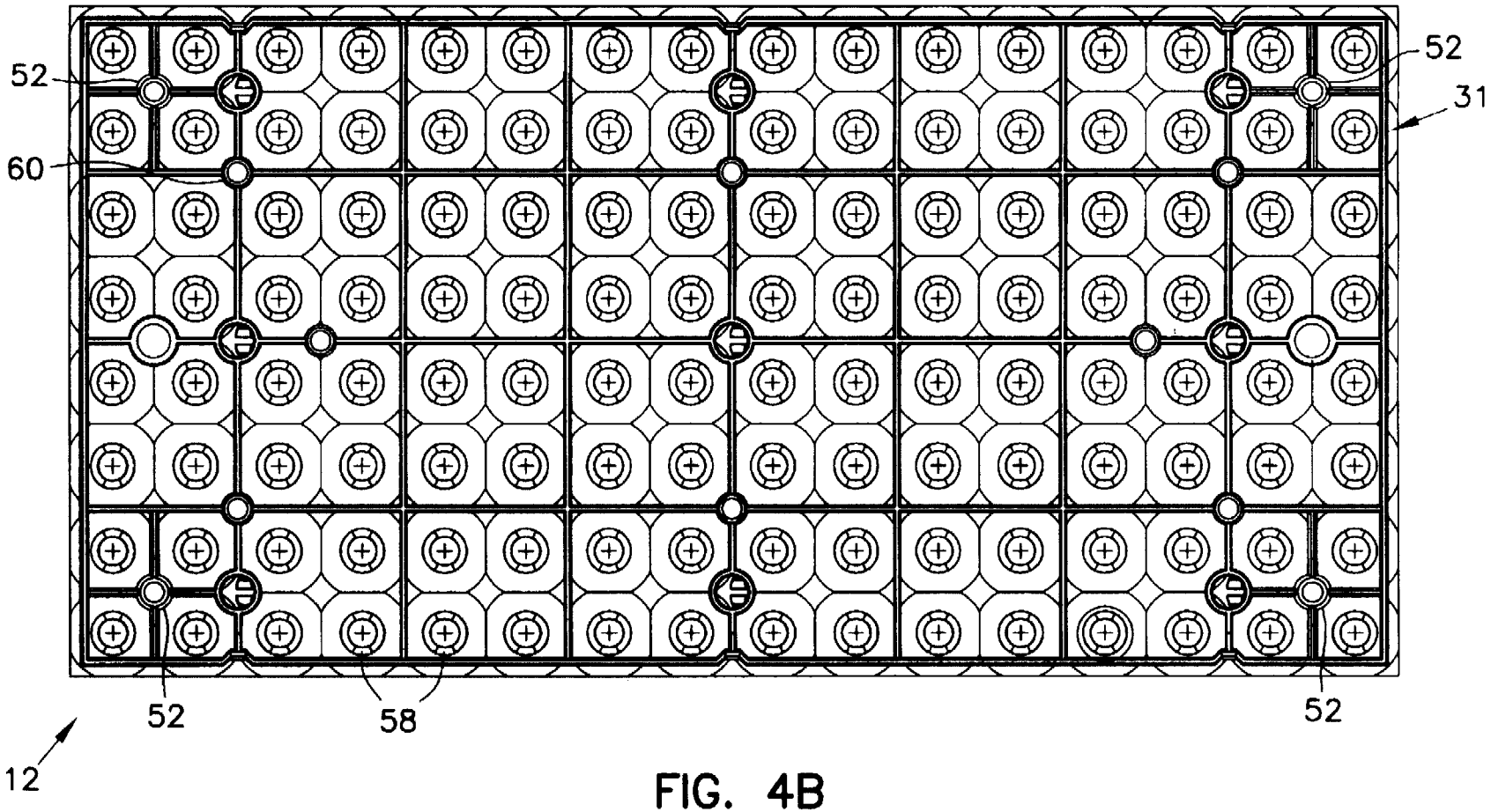
FIG. 4B is a rear view of the multiple pixel reflector as shown in FIG. 4A.
Figure 4C:
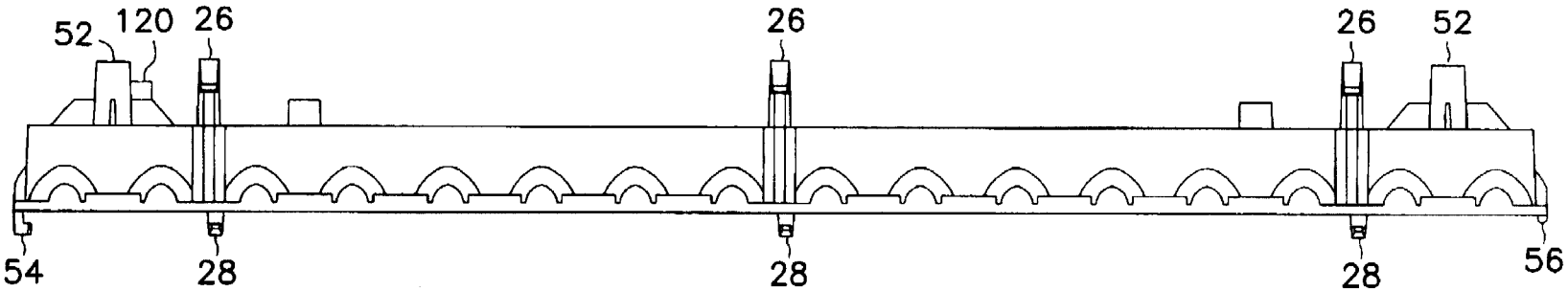
FIG. 4C is a top view of the multiple pixel reflector of FIG. 4A.
Figure 4D:
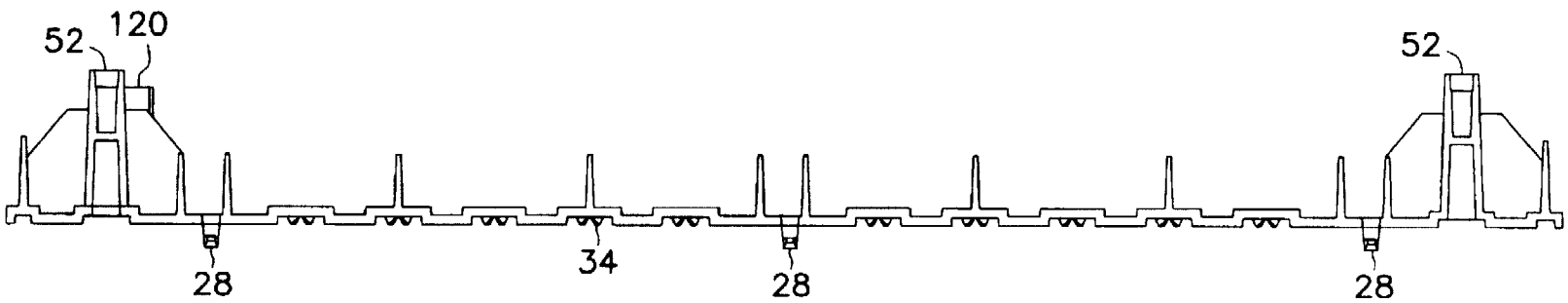
FIG. 4D is a section view of the multiple pixel reflector on the line 4D—4D of FIG. 4A.
Figure 4G:
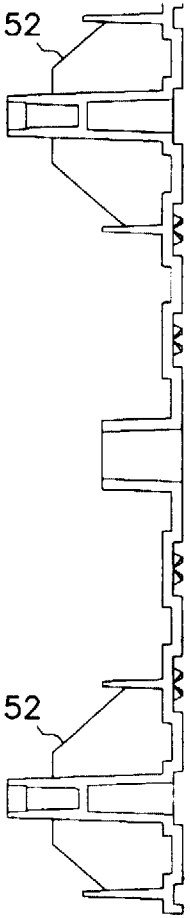
FIG. 4G is a section view of the multiple pixel reflector on the line 4G—4G of FIG. 4A.
Figure 4F:
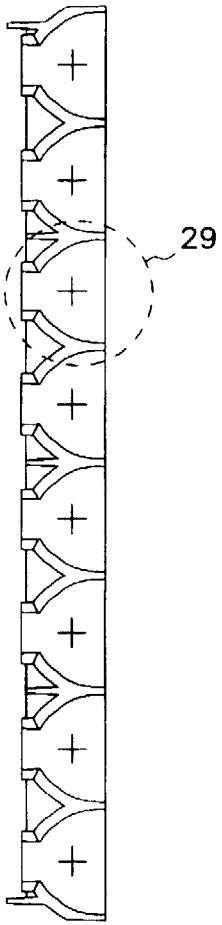
FIG. 4F is a section view of the multiple pixel reflector on the line 4F—4F of FIG. 4A.
Figure 4E:
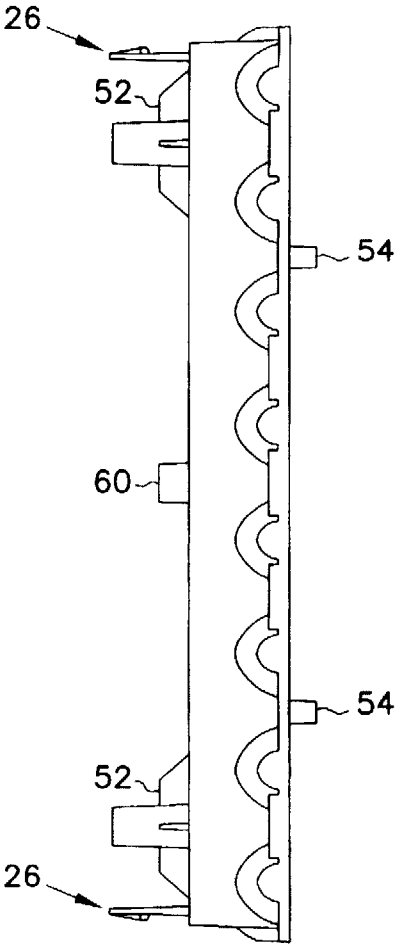
FIG. 4E is a side view of the multiple pixel reflector of FIG. 4A.
Figure 4J:
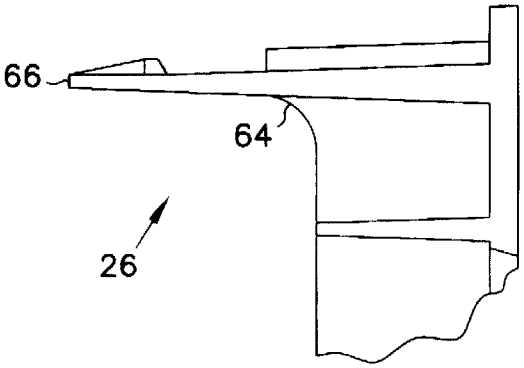
FIG. 4J is a detailed view of a printed circuit board clip of the multiple pixel reflector as shown in FIG. 4H.
Figure 4I:
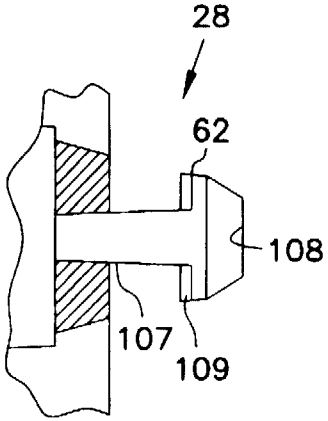
FIG. 4I is a detailed view of a lens mount tee of the multiple pixel reflector as shown in FIG. 4H.

As previously discussed with regard to mounting of the lens 14 onto the multiple pixel reflector 12, the matrix framework 31 further includes lens retainer catch tabs 54, as shown in FIG. 4D and FIG. 4A, and also lens edge knob tabs as shown in FIG. 4A and FIG. 4D. The lens edge knob tabs 56 and the lens retainer catch tabs 54 each extend forward from the matrix framework 31. The lens edge knob tabs 56 are a block like structure that only abuts the lens when mounted, whereas the lens retainer catch tabs 54 include an L-shaped structure which abuts the lens 14 when mounted and also engages the lens with one leg of the tab holding the outer surface of the lens 14. Such retaining structure allows for ease of lens service.

Figure 4H:
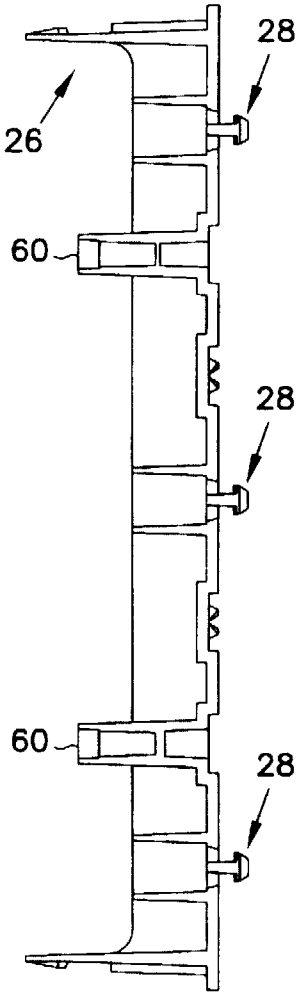
FIG. 4H is a section view of the multiple pixel reflector on the line 4H—4H of FIG. 4A.

A rear view of the multiple pixel reflector 12 is shown in FIG. 4B. Extending perpendicularly rearward from the matrix framework 31, as shown in FIG. 4B, and also FIG. 4H, are printed circuit board standoffs 60, which assist in maintaining the spacing between the printed circuit board 18 and the multiple pixel reflector 12 when the lamps 16 are positioned within cavities 1–5 as shown in FIG. 1B. Sockets of the lamps 16 which abut the reflector mounting holes 58 also assist in maintaining such spacing. The standoffs 60 are constructed such that, with a special tool, they can be removed through standoff holes 36 and a screw or other fastening means can be utilized to maintain the printed circuit board 18 in position if for some reason the circuit board mounting clips previously discussed herein fail.

Further standoffs include reflector standoff and bracket screw mounts 52 which are located toward the corners of the multiple pixel reflector 12. These standoffs 52 which extend rearward from the matrix framework 31 also function to maintain the spacing between the multiple pixel reflector 12 and the printed circuit board 18. In addition, the standoffs 52 function for mounting the mounting brackets 22 as previously discussed. Each of these reflector standoffs 52 include wings for providing the standoff function which extend in opposite directions from a cylindrical member utilized with fasteners 24 to mount the mounting brackets 22. The cylindrical member inserts into mounting holes 42 of printed circuit board 18. One set of wings of one standoff 52 includes a printed circuit board orientation tab 120, which requires the printed circuit board 18 as shown in FIG. 3 to be mounted on the multiple pixel reflector 12 in only one orientation. The key 44 of printed circuit board 18, as shown in FIG. 3, is sized to match the printed circuit board orientation tab 120 in order to provide such ease in installation.

Figure 6C:
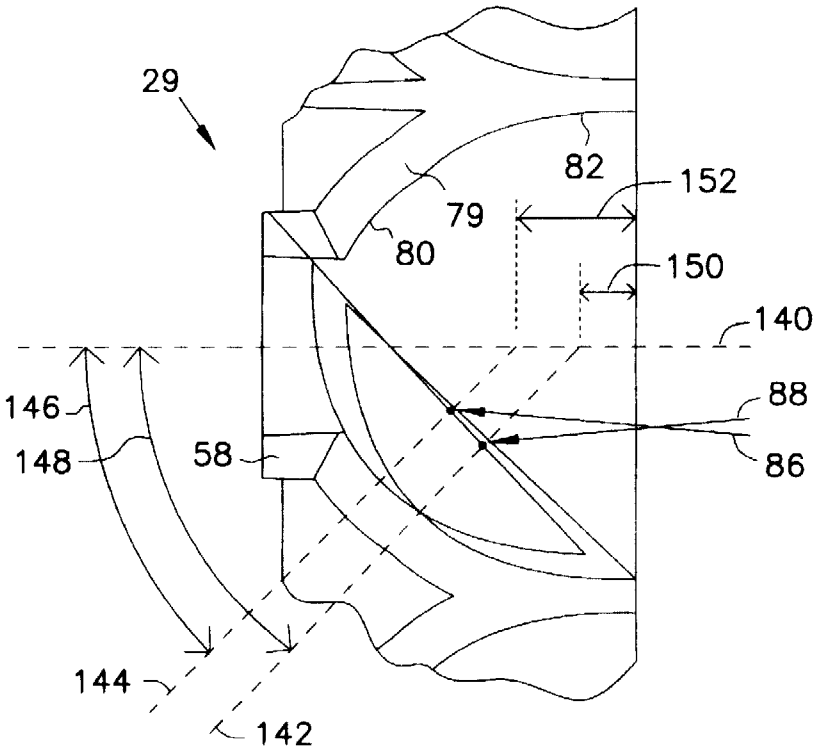
FIG. 6C is a detailed section view of a reflector of the multiple pixel reflector on line 4F—4F of FIG. 4A and as shown in FIG. 4F.
Figure 6B:
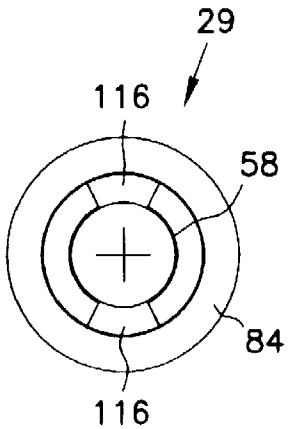
FIG. 6B is a rear view of the reflector of FIG. 6A.
Figure 6A:
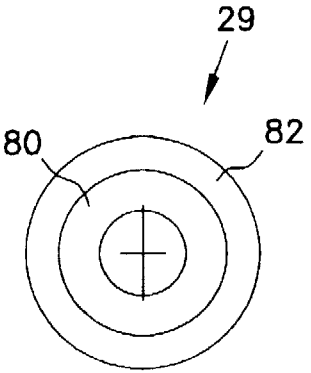
FIG. 6A is a front view of a reflector surface of a reflector of the multiple pixel reflector of FIG. 4A.

Each reflector 29, supported by the matrix framework 31 of the multiple pixel reflector 12, is shown in detail in FIGS. 6A–6C. In the rear view of FIG. 6B, the reflector 29 includes lamp mounting hole 58. The mounting hole 58 is formed by a cylinder, which cylinder is adjacent the reflector body 79. Reflector body 79 has an outer rear surface 84 and two inner parabolic surfaces 80 and 82. The two inner parabolic surfaces are shown in the top view of the reflector of FIG. 6A. The cylindrical mounting hole 58 includes two slots 116 therein in order to allow for air to pass from behind the lamp matrix display module 10 into cavity 15, shown in FIG. 1B. With the use of the slots 116, a path is provided for air to flow into the reflector cavity 15 and out to the front of the prismatic lens 14 through the edge air vents 35 and the air vents 34 for ventilation purposes.

As shown in FIG. 6C, the first partial parabolic surface 80 is rotated from the second partial parabolic surface 82. The focal points of the two partial parabolic surfaces are therefore offset. The focal point of the first parabolic surface 80 is shown by pointer 86 which is offset from the focal point of the second parabolic surface 82 shown by pointer 88. The partial parabolic surfaces 80 and 82 can be described as being rotated and off focal point to provide for wide angle viewing and straightforward illumination intensity. The axis 144 of the first parabolic surface 80 is rotated a predetermined angle 146 from the center line 140 of the reflector 29 in a plane separating the reflector 29 along the line 4F—4F shown in FIG. 4A. The axis 142 of the second parabolic surface 82 is rotated a predetermined angle 148 from the center line 140 of the reflector in a plane separating the reflector 29 along the line 4F—4F shown in FIG. 4A. The point of rotation for the first parabolic surface 80 is a point on the center line 140 a predetermined distance 152 from the plane defined by the outer edge of the reflector 29. The point of rotation for the second parabolic surface 82 is a point on the center line 140 a predetermined distance 150 from the plane defined by the outer edge of the reflector 29. The parabola equation utilized to construct the surfaces is as follows: $Y^2=4*F*X$, wherein F is equal to 0.15 inches for reflectors utilized with a display having lamps positioned at ¾" center to center. Further, the first and second parabolas are rotated about 43 degrees and 46.3 degrees, respectively, for a display having lamps positioned at ¾" center to center and the predetermined distances 150, 152 are about 0.08 and 0.18 inches for a display having lamps positioned at ¾" center to center.

One skilled in the art will recognize that although the preferred embodiment of the invention is described with two partial parabolic surfaces, that more partial surfaces may be utilized with such parabolic surfaces and that the present invention is not limited to the use of two such surfaces but only limited as described in the accompanying claims. Further, a reflector having multiple partial parabolic surfaces may be utilized in combination with structure substantially different than the structure described herein and is only limited as described in the accompanying claims.

The circuit board 18 as shown in FIG. 3 and the features thereof, including the key 44 for orientation of the printed circuit board 18 to the multiple pixel reflector 12, and clip holes 50, have been discussed previously. The circuit board 18 further includes various holes necessary to accomplish some of the features previously discussed. For example, standoff holes 46 would allow the standoff to be removed and the display module attached by fastening means through the standoff holes 46 in the circuit board. Further, also as previously discussed, the printed circuit board is for mounting of the lamps 16.

The multiple pixel prismatic lens 14 of the multiple pixel matrix display 10 is shown in detail in FIGS. 7A–7F. In the front view of FIG. 7A, the multiple pixel prismatic lens 14 is shown to include lens air apertures 32, lens edge air apertures 33, the lens keyhole mount retainers 30, gate positions 40 for manufacturing purposes, and notches 90, which allow for engagement with the edge knob tabs 56 and lens retainer catch tabs 54. These elements have all been previously discussed, including the lens keyhole mount retainers 30 shown in detail in FIG. 7E.

Figure 7C:
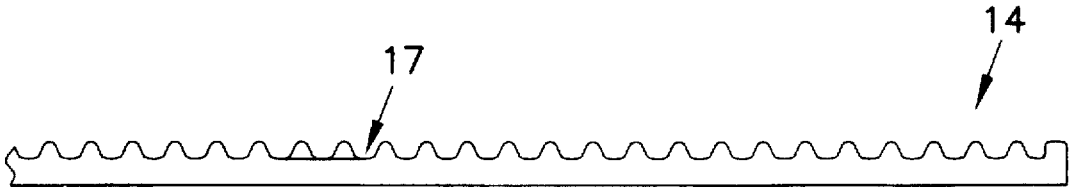
FIG. 7C is a section view of vertical prisms on line 7C—7C of the multiple pixel prismatic lens of FIG. 7A.
Figure 7D:
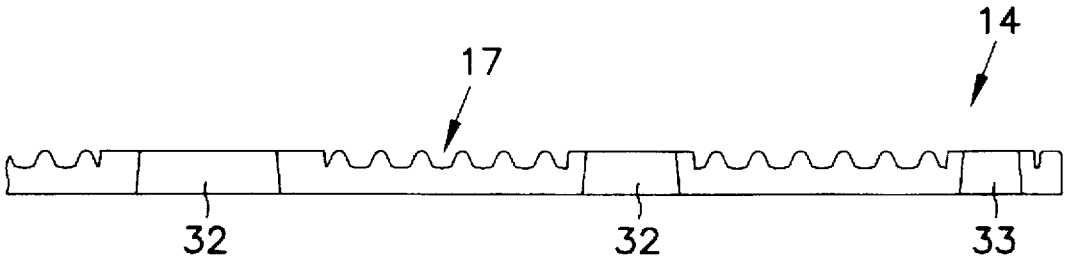
FIG. 7D is a section view of vertical prisms and air apertures on line 7D—7D of the multiple pixel prismatic lens of FIG. 7A.
Figure 7E:
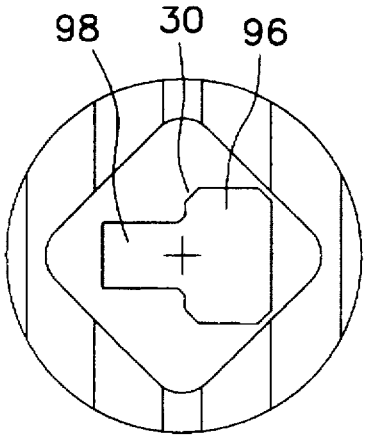
FIG. 7E is a detailed view of a lens mount hole of the multiple pixel prismatic lens of FIG. 7A.
Figure 7F:
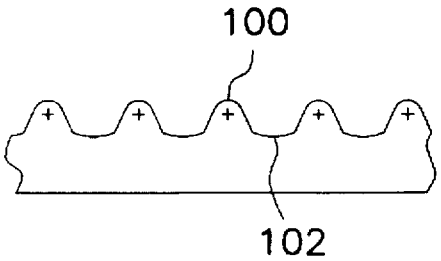
FIG. 7F is a detailed view of several vertical prisms of the vertical prisms as shown in a section view on line 7F—7F of FIG. 7C.

The prismatic lens 14 further includes vertical prisms 17 as shown in the section views on lines 7C—7C and 7D—7D of FIG. 7A, shown respectively in FIGS. 7C and 7D. FIG. 7D also shows the apertures 32 and 33, which have a larger diameter at the inner surface of the lens as opposed to a smaller diameter at the outer surface of the lens in order to provide for better air movement therethrough. The vertical prisms 17 are further shown in detail in FIG. 7F and include peaks 100 having a predetermined radius and valleys 102 also having a predetermined radius. The radiuses are determined as a function of the overall structure of the device, and particularly depending upon the dispersion pattern of light desired therethrough. In addition, the number of peaks and valleys covering the multiple pixels of the lamp matrix display module 10 also depends upon the desired dispersion pattern. In one particular embodiment for a display having lamps at ¾" center to center, a valley radius of 0.045, a peak radius of 0.012, and a spacing of peaks at 0.075 have been utilized. Such dimensions are described for example only and given that desired outputs may be customized, are not to be taken as limiting the invention described herein in any manner, but rather the invention is only limited as described in the accompanying claims. It is known that, by having vertical prisms on the outer surface of the lens 14, glare can be reduced for the multiple pixel lamp matrix display module 10 and that wide angle light viewing is enhanced.

FIG. 7B shows the rear view of the prismatic lens 14. The inner surface or rearward facing surface which is opposite of the outer prismatic surface, is screen printed. Pixel layout circles 92 are screen printed on the rear surface and flat black dividers 94 are also screen printed thereon for covering between reflectors. The pixel layout circles 92 include groups of blue, red, white, and green colored pixel circles as is commonly known in the art and which shall not be further discussed in detail.

It should be recognized by one skilled in the art that the concepts and ideas described herein are equally applicable to indoor and outdoor displays. In addition, these concepts, including having multiple partial parabolic surfaces such as that described herein, may be utilized in conjunction with other display reflectors, not necessarily wherein multiple pixels are covered by a single lens. It is apparent that many modifications and variations of this invention as described above may be made without departing from the spirit and scope thereof. The specific embodiments as described are given by way of example only. The invention is limited only by the terms of the appended claims.

What is claimed is:

1. A lamp matrix display, comprising:

a vertical planar array of light sources arranged in rows and columns;

a plurality of reflectors, each reflector positioned about a corresponding light source and having a reflective surface for directing light emitted from the light source in a forward direction, the reflective surface of at least one of the plurality of reflectors is formed in a cavity having a central axis and includes:

a first parabolic reflective surface having a first focal point offset from the central axis; and a second parabolic reflective surface adjacent the first parabolic reflective surface having a second focal point offset from the first focal point of the first parabolic surface and offset from the central axis; and at least one lens mounted in front of at least one of the plurality of reflectors.

2. The display according to claim 1, wherein the at least one lens includes a single lens mounted directly in front of the plurality of reflectors, the single lens including:

an inner flat surface disposed adjacent an outer edge of each reflector surface; and an outer prismatic surface having vertical prisms to horizontally spread the light from the planar array of light sources.

3. A lamp matrix display, comprising:

a vertical planar array of light sources arranged in rows and columns;

a plurality of reflectors each reflector positioned about a corresponding light source and having a reflective surface for directing light emitted from the light source in a forward direction, the reflective surface of at least one of the plurality of reflectors including:

a first parabolic reflective surface having a first focal point: and a second parabolic reflective surface adjacent the first parabolic reflective surface having a second focal point offset from the first focal point of the first parabolic surface; and at least one lens mounted in front of at least one of the plurality of reflectors, the at least one lens includes a single lens mounted directly in front of the plurality of reflectors, the single lens including:

an inner flat surface disposed adjacent an outer edge of each reflector surface; and an outer prismatic surface having vertical prisms to horizontally spread the light from the planar array of light sources.

the plurality of reflectors are structurally supported about corresponding light sources by a matrix framework, the matrix framework including a plurality of air vents, at least one of the air vents being positioned between four adjacent reflectors, the air vent including:

a recessed region in the matrix framework, the recessed region open in the forward direction and recessed below a plane established by outer edges of the four adjacent reflectors; and an opening between the recessed region and a cavity defined by the reflective surface of one of the four adjacent reflectors.

4. The lamp matrix display according to claim 3, further including a light blocking structure disposed in the recessed region to block light exiting through the at least one opening.

5. The lamp matrix display according to claim 3, wherein the single lens includes a plurality of air vent apertures corresponding to the plurality of air vents and positioned in the single lens to allow air entering the recessed region of the corresponding air vent to exit therethrough.

6. The lamp matrix display according to claims 3, wherein each reflector includes a light source mount aperture extending rearward of the reflective surface of the reflector, the light source mount aperture defined by at least one wall having at least one notch along a rear edge thereof to let air forced from the rear of the plurality of reflectors into the at least one cavity.

7. A lamp matrix display comprising:

a vertical planar array of light sources arranged in rows and columns:

a plurality of reflectors, each reflector positioned about a corresponding light source and having a reflective surface for directing light emitted from the light source in a forward direction the reflective surface of at least one of the plurality of reflectors including:

a first parabolic reflective surface having a first focal point; and a second parabolic reflective surface adjacent the first parabolic reflective surface having a second focal point offset from the first focal point of the first parabolic surface; and at least one lens mounted in front of at least one of the plurality of reflectors, the at least one lens includes a single lens mounted directly in front of the plurality of reflectors, the single lens including:

an inner flat surface disposed adjacent an outer edge of each reflector surface; and an outer prismatic surface having vertical prisms to horizontally spread the light from the planar array of light sources.

the plurality of reflectors are structurally supported about corresponding light sources by a matrix framework, the matrix framework including a plurality of mounting projections extending forwardly from the matrix framework and forward of the plurality of reflectors, and further wherein the single lens includes a plurality of retaining apertures, each retaining aperture corresponding to one of the mounting projections, each retaining aperture having a receiving region for receiving the corresponding mounting projections and a holding region for releasably holding the single lens directly and in contact with the outer edge of each reflector surface.

8. A lamp matrix display, comprising:

a vertical planar array of light sources arranged in rows and columns;

a plurality of reflectors, each reflector positioned about a corresponding light source and having a reflective surface for directing light emitted from the light source in a forward direction the reflective surface of at least one of the plurality of reflectors including:

a first parabolic reflective surface having a first focal point; and a second parabolic reflective surface adjacent the first parabolic reflective surface having a second focal point offset from the first focal point of the first parabolic surface; and at least one lens mounted in front of at least one of the plurality of reflectors, the at least one lens includes a single lens mounted directly in front of the plurality of reflectors, the single lens including:

an inner flat surface disposed adjacent an outer edge of each reflector surface; and an outer prismatic surface having vertical prisms to horizontally spread the light from the planar array of light sources, the plurality of reflectors are structurally supported about corresponding light sources by a matrix framework, the matrix framework including a plurality of board clips extending rearwardly from the matrix framework and rearward of the plurality of reflectors, and further wherein the lamp matrix display includes a circuit board for mounting the plurality of light sources in the rows and columns, the circuit board including a plurality of clip apertures, each clip aperture corresponding to one of the plurality of board clips and positioned in the circuit board for receiving the corresponding board clip and releasably holding the circuit board a position behind the plurality of reflectors.

9. The lamp matrix display according to claim 8, wherein the matrix framework further includes a plurality of standoffs extending rearwardly from the matrix framework and rearward of the plurality of reflectors to maintain a predetermined distance between the circuit board and plurality of reflectors while positioning the light sources mounted on the circuit board within the corresponding reflectors and further to provide for mounting of at least two mounting brackets, one of the plurality of standoffs including a standoff keying structure; and further wherein the circuit board includes mounting apertures corresponding to certain of the plurality of standoffs utilized to mount the at least two mounting brackets, one of the mounting apertures including a board keying structure corresponding to the standoff keying structure to assure proper orientation of the circuit board when mounted via the plurality of board clips.

10. The lamp matrix display according to claim 8, wherein the matrix framework further includes a plurality of standoffs extending rearwardly from the matrix framework and rearward of the plurality of reflectors to maintain a predetermined distance between the circuit board and plurality of reflectors while positioning the light sources mounted on the circuit board within the corresponding reflectors and further to provide for mounting of at least two mounting brackets;

further wherein the circuit board includes mounting apertures corresponding to certain of the plurality of standoffs utilized to mount the at least two mounting brackets; and further wherein the single lens, matrix framework, and the mounting bracket each include apertures for allowing access to a fastening means for fastening the lamp matrix display to a display board including a plurality of lamp matrix displays.

11. The lamp matrix display according to claim 10, further includes a flexible air blocking strip along at least two sides of the matrix framework such that when positioned alongside other display modules air is block from escaping therebetween.

12. A lamp matrix display, comprising:

a vertical planar array of light sources arranged in rows and columns;

a plurality of reflectors, each reflector positioned about a corresponding light source and having a reflective surface for directing light emitted from the light source in a forward direction; and a single lens mounted directly in front of the plurality of reflectors; and a matrix framework to structural support the plurality of reflectors about the corresponding light sources, the matrix framework including a plurality of air vents, at least one of the air vents being positioned between four adjacent reflectors, the at least one air vent including:

a recessed region in the matrix framework, the recessed region open in the forward direction and recessed below a plane established by outer edges of the four adjacent reflectors;

an opening between the recessed region and a cavity defined by the reflective surface of one of the four adjacent reflectors; and a light blocking structure disposed in the recessed region to block light exiting through the opening.

13. The lamp matrix display according to claim 12, wherein the light blocking structure disposed in the recessed region includes a pyramidal shaped barrier, the pyramidal shaped barrier having a polygonal wall faced directly towards the cavity defined by the reflective surface of the one of the four adjacent reflectors.

14. The lamp matrix display according to claim 12, wherein the single lens includes a plurality of air vent apertures corresponding to the plurality of air vents and positioned in the single lens to allow air entering the recessed region of the corresponding air vent to exit therethrough.

15. The lamp matrix display according to claim 12, wherein each reflector includes a light source mount aperture extending rearward of the reflective surface of the reflector, the light source mount aperture defined by at least one wall having at least one notch along a rear edge thereof to let air forced from the rear of the plurality of reflectors into the at least one cavity.

16. A lamp matrix display comprising:

a vertical planar array of light sources arranged in rows and columns;

a plurality of reflectors each reflector positioned about a corresponding light source and having a reflective surface for directing light emitted from the light source in a forward direction;

a single lens mounted directly in front of the plurality of reflectors; and a matrix framework to structurally support the plurality of reflectors about the corresponding light sources, the matrix framework includes a plurality of mounting projections extending forwardly from the matrix framework and forward of the plurality of reflectors; and wherein the single lens includes a plurality of retaining apertures, each retaining aperture corresponding to one of the mounting projections, each retaining aperture having a receiving region for receiving the corresponding mounting projections and a holding region for releasably holding the single lens directly and in contact with an outer edge of each reflector surface;

the matrix framework further includes at least one catch projection positioned at a first edge of the matrix framework and extending forwardly therefrom to engage a first edge of the single lens when the mounting projections are engaged in the corresponding retaining apertures to releasably hold the first edge of the single lens directly and in contact with the first edge of the matrix framework.

17. The lamp matrix display according to claim 16, wherein the matrix framework further includes at least one knob projection positioned at a second edge of the matrix framework opposite the first edge of the matrix framework and extending forwardly from the matrix framework to engage a second edge of the single lens opposite the first edge of the single lens when the at least one catch projection releasably holds the first edge of the single lens to releasably hold the second edge of the single lens directly and in contact with the second edge of the matrix framework.

18. A lamp matrix display, comprising:

a vertical planar array of light sources arranged in rows and columns;

a plurality of reflectors, each reflector positioned about a corresponding light source and having a reflective surface for directing light emitted from the light source in a forward direction;

a single lens mounted directly in front of the plurality of reflectors; and a matrix framework to structurally support the plurality of reflectors about the corresponding light sources, the matrix framework includes a plurality of mounting projections extending forwardly from the matrix framework and forward of the plurality of reflectors; and wherein the single lens includes a plurality of retaining apertures, each retaining aperture corresponding to one of the mounting projections, each retaining aperture having a receiving region for receiving the corresponding mounting projections and a holding region for releasably holding the single lens directly and in contact with an outer edge of each reflector surface;

the matrix framework including a plurality of board clips extending rearwardly from the matrix framework and rearward of the plurality of reflectors, and further wherein the lamp matrix display includes a circuit board for mounting the plurality of light sources in the rows and columns, the circuit board including a plurality of clip apertures, each clip aperture corresponding to one of the plurality of board clips and positioned in the circuit board for receiving the corresponding board clip and releasably holding the circuit board a position behind the plurality of reflectors.

19. The lamp matrix display according to claim 18, wherein the matrix framework further includes a plurality of standoffs extending rearwardly from the matrix framework and rearward of the plurality of reflectors to maintain a predetermined distance between the circuit board and plurality of reflectors while positioning the light sources mounted on the circuit board within the corresponding reflectors and further to provide for mounting of at least two mounting brackets, one of the plurality of standoffs including a standoff keying structure; and further wherein the circuit board includes mounting apertures corresponding to certain of the plurality of standoffs utilized to mount the at least two mounting brackets, one of the mounting apertures including a board keying structure corresponding to the standoff keying structure to assure proper orientation of the circuit board when mounted via the plurality of board clips.

20. The lamp matrix display according to claim 18, wherein the matrix framework further includes a plurality of standoffs extending rearwardly from the matrix framework and rearward of the plurality of reflectors to maintain a predetermined distance between the circuit board and plurality of reflectors while positioning the light sources mounted on the circuit board within the corresponding reflectors and further to provide for mounting of at least two mounting brackets;

further wherein the circuit board includes mounting apertures corresponding to certain of the plurality of standoffs utilized to mount the at least two mounting brackets; and further wherein the single lens, matrix framework, and the mounting bracket each include apertures for allowing access to a fastening means for fastening the lamp matrix display to a display board including a plurality of lamp matrix displays.

21. The lamp matrix display according to claim 20, further includes a flexible air blocking strip along at least two sides of the matrix framework such that when positioned alongside other display modules air is block from escaping therebetween.

* * * * *